US006554630B2

(12) United States Patent
Uratani

(10) Patent No.: US 6,554,630 B2
(45) Date of Patent: Apr. 29, 2003

(54) MOVABLE TERMINAL, COAXIAL CONNECTOR, AND COMMUNICATION APPARATUS

(75) Inventor: Chikara Uratani, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/924,633

(22) Filed: Aug. 8, 2001

(65) Prior Publication Data

US 2002/0034890 A1 Mar. 21, 2002

(30) Foreign Application Priority Data

Aug. 11, 2000 (JP) ..... 2000-244622

(51) Int. Cl.[7] ..... H01R 29/00
(52) U.S. Cl. ..... 439/188
(58) Field of Search ..... 439/188, 63, 578

(56) References Cited

U.S. PATENT DOCUMENTS 5,139,427 A * 8/1992 Boyd et al. ..... 439/66
5,281,176 A 1/1994 Yahagi et al. ..... 439/887
5,575,690 A * 11/1996 Eaton ..... 439/717
5,625,177 A * 4/1997 Yukinori et al. ..... 200/1 R
6,068,492 A * 5/2000 Uratani et al. ..... 439/63
6,099,334 A * 8/2000 Togashi ..... 439/188

FOREIGN PATENT DOCUMENTS

EP 0 929 128 7/1999
EP 0929128 A1 * 7/1999

* cited by examiner

*Primary Examiner*—Tulsidas Patel
(74) *Attorney, Agent, or Firm*—Keating & Bennett, LLP

(57) ABSTRACT

A movable terminal, a coaxial connector, and a communication apparatus all have a greatly reduced size and height. The coaxial connector includes an insulating case made from a synthetic resin and divided into a lower insulating case and an upper insulating case, a metallic fixed terminal, a movable terminal, and an external terminal (external conductor). The movable terminal is formed by punching a stainless steel plate made of SUS 301 having a spring property so as to have a predetermined shape and bending it. Then, on surfaces of the stainless steel (SUS 301), nickel plating films are formed and on the nickel plating films, gold is further plated so that the movable terminal has an overall thickness in the range of from about 45 $\mu$m to about 62 $\mu$m.

18 Claims, 4 Drawing Sheets

MOVABLE TERMINAL, COAXIAL CONNECTOR, AND COMMUNICATION APPARATUS

BACKGROUND OF THE INVENTION

1. Field of the Invention

The present invention relates to a movable terminal, a coaxial connector, and a communication apparatus.

2. Description of the Related Art

In conventional mobile communication equipment such as portable telephones, there are apparatuses including a surface-mounting-type coaxial connector that performs the function of switching a signal path. The coaxial connector includes a resin case, a fixed terminal, and a movable elastic terminal, which are formed integrally therewith by insert molding. A movable terminal used in a conventional surface-mounting type coaxial connector may be a cantilever type and is frequently made from phosphor bronze.

In accordance with recent advances in miniaturization of the coaxial connector and reduction of the height and overall size thereof, miniaturizing of the movable terminal, however, is also required, so that the size of a movable spring portion and the thickness of the movable terminal have to be reduced. In a cantilever structure, however, in order to have a required contact-point pressure between the movable terminal and the fixed terminal, the thickness of the material must be comparatively large. Also, in the cantilever structure, in order to prevent connector deficiencies caused by plastic deformation of the lever, the entire length of the lever must be large. Therefore, the miniaturization of the movable terminal is prevented which therefore prevents miniaturization of the connector itself.

SUMMARY OF THE INVENTION

In order to overcome the problems described above, preferred embodiments of the present invention provide a movable terminal, a coaxial connector, and a communication apparatus that are significantly miniaturized and have a greatly reduced height and overall dimensions.

A movable terminal according to a preferred embodiment of the present invention includes a frame, a movable spring portion that is arranged such that both ends thereof are supported by the frame and a central portion thereof is movable and is elastic, a contact portion that is integral with the movable spring portion and which comes into contact with and connects to a fixed terminal, wherein at least the movable spring portion is made of SUS 301 stainless steel.

Preferably, on surfaces of the SUS 301 stainless steel, nickel plating films are preferably disposed and on surfaces of the nickel plating films, gold plating films are preferably disposed. In addition, it is preferable that the entire thickness of the SUS 301 stainless steel with the nickel plating films and the gold plating films disposed thereon ranges from about 45 νm to about 62 νm.

A coaxial connector according to another preferred embodiment of the present invention includes an insulating case having a recess provided therein into which a central contact of another coaxial connector is inserted, a movable terminal according to the preferred embodiment described above which is arranged within the recess of the insulating case so as to protrude in a direction that is substantially perpendicular to the inserting direction of the central contact of the other coaxial connector, a fixed terminal arranged within the recess of the insulating case so as to be brought into contact with and connected to the contact portion of the movable terminal, an external terminal attached to the outside of the insulating case and electrically connected to an external conductor of the other coaxial connector, and the contact portion of the movable terminal is movable from a position where the contact portion is separated from the fixed terminal to a position where the contact portion contacts the fixed terminal in accordance with attachment and detachment of the other coaxial connector.

According to the preferred embodiment of the present invention described above, the movable terminal includes a beam that is supported at both ends and has a spring force that is larger than that of a conventional movable terminal due to a movable spring portion of a beam structure supported at both ends and preferably made from SUS 301 stainless steel. Therefore, even when the movable terminal is reduced in size and in thickness of the material, secure and stable contact and connection can be obtained. Moreover, even when the thickness of the SUS 301 stainless steel varies, by plating the SUS 301 stainless steel with nickel having a Young's modulus that is similar to that of the SUS 301 stainless steel, changes in the spring force due to errors in the thickness of the SUS 301 stainless steel of the movable spring portion are compensated for.

A communication apparatus according to another preferred embodiment including such a coaxial connector has a greatly reduced thickness and weight.

Other features, elements, characteristics and advantages of the present invention will become apparent from the following detailed description of preferred embodiments thereof with reference to the attached drawings.

DETAILED DESCRIPTION OF PREFERRED EMBODIMENTS

Preferred embodiments of the present invention including a movable terminal, a coaxial connector, and a communication apparatus will be described below with reference to the attached drawings.

Figure 1:
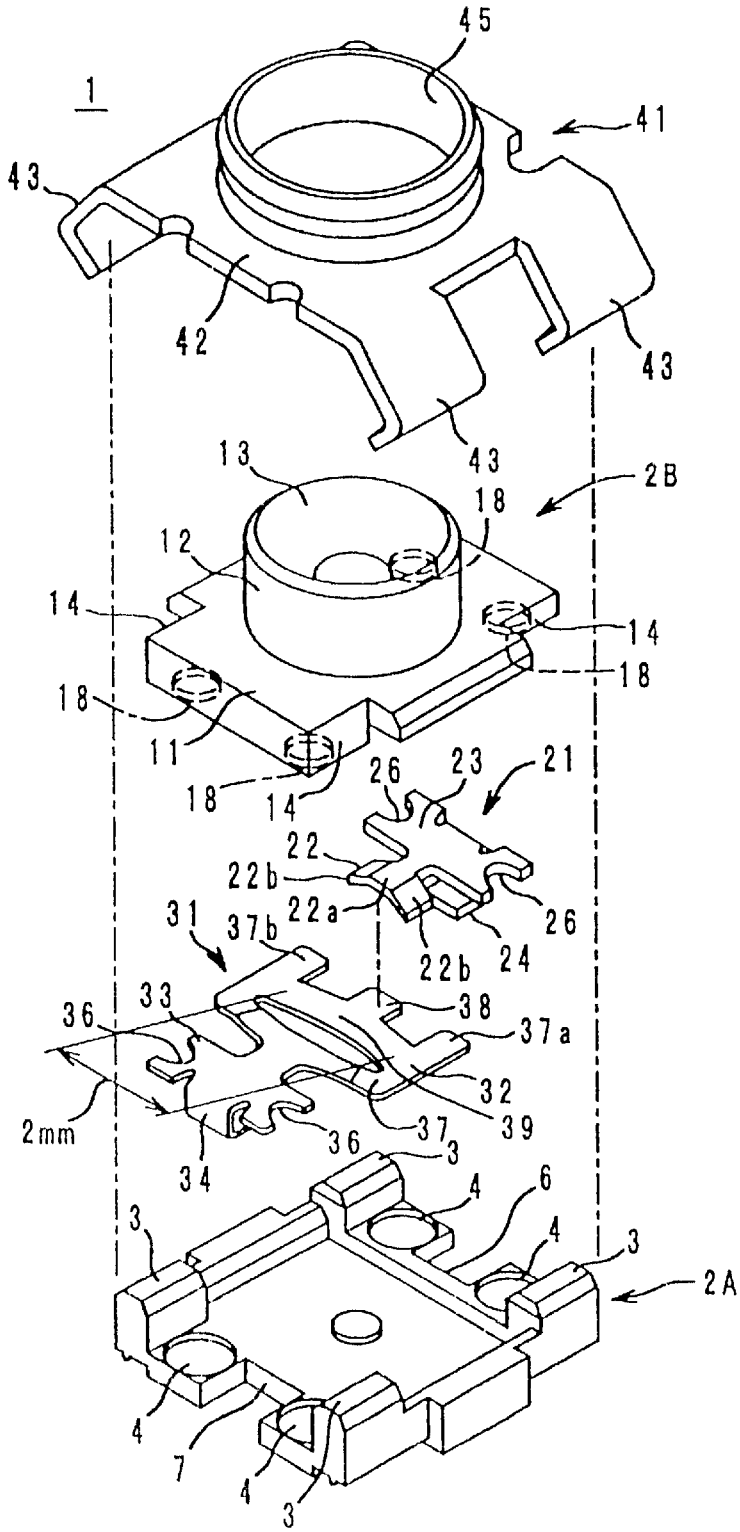
FIG. 1 is an assembly view of a coaxial connector according to a preferred embodiment of the present invention.
Figure 2:
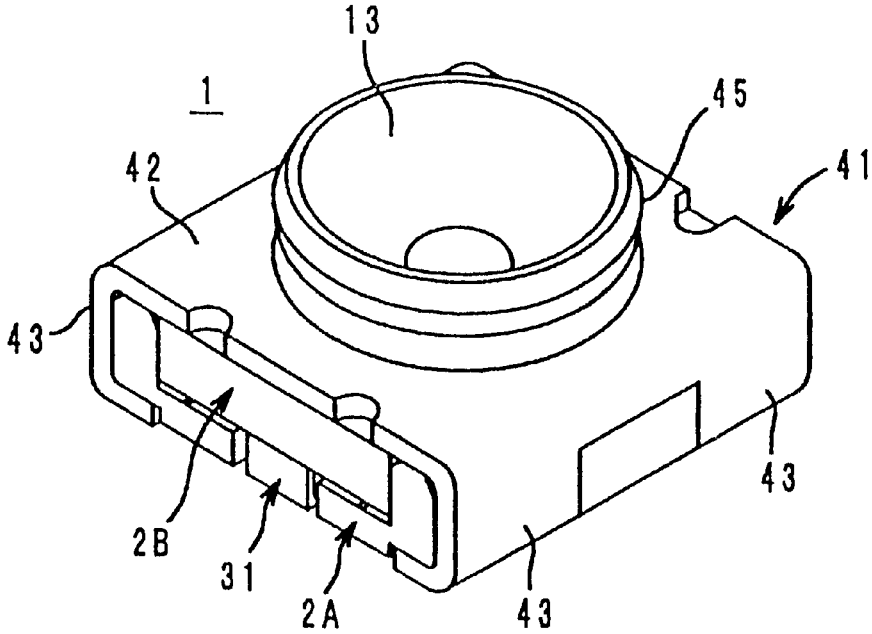
FIG. 2 is an exterior perspective view of the coaxial connector shown in FIG. 1.

FIG. 1 shows an assembly view of a preferred embodiment of a coaxial connector according to the present invention, and FIG. 2 is an exterior perspective view thereof. The coaxial connector (coaxial receptacle) 1 preferably includes an insulating case made from a synthetic resin and divided into a lower insulating case 2A and an upper insulating case 2B, a metallic fixed terminal 21, a movable terminal 31, and an external terminal (external conductor) 41.

The lower insulating case 2A preferably has a substantially rectangular shape, and the four corners on the top surface (dividing surface) thereof are provided with guide projections 3 for positioning the upper insulating case 2B. In the vicinity of the guide projections 3, leg-receivers 4 are provided for receiving legs 18 disposed on the bottom surface (dividing surface) of the upper insulating case 2B. Furthermore, substantially rectangular cut-outs 6 and 7 are provided in the respective central portions of two sides, which oppose each other, of the lower insulating case 2A. In the cut-out 6, a lead 24 of the fixed terminal 21 is accommodated while a lead 34 of the movable terminal 31 is accommodated in the cut-out 7.

The upper insulating case 2B includes a substantially rectangular cover 11 and a substantially cylindrical introducing section 12 disposed in the central portion on the top surface of the cover 11. The substantially cylindrical introducing section 12 is upwardly opened to have a conical shape and has a substantially circular-cross-sectional introduction hole 13. The introduction hole 13 penetrates the upper insulating case 2B. Into the introduction hole 13, a central contact of a coaxial connector of another component is inserted from the conical opening. On the other hand, four corners of the cover 11 are provided with cut-outs 14 which are fitted by the guide projections 3 of the lower insulating case 2A so that the upper insulating case 2B and the lower insulating case 2A are assembled together with a high degree of positional accuracy.

The fixed terminal 21 is preferably formed by punching and bending a flat metallic plate, and preferably includes a contact portion 22 that defines a contact of the movable terminal 31, a fixed portion 23 that is sandwiched and fixed by insulating cases 2A and 2B therebetween and thereto, and a lead 24 bent to have a substantially L-shaped configuration. The contact portion 22 is preferably formed by bending both ends thereof at a predetermined angle, and has a horizontal plane 22*a* and inclined planes 22*b* on both sides of the horizontal plane 22*a*.

On both sides of the fixed portion 23, substantially semi-circular recesses 26 are provided and are respectively fitted by the legs 18 of the upper insulating case 2B, so that the fixed terminal 21 is connected to the upper insulating case 2B with a high degree of positional accuracy. At this time, the fixed terminal 21 is arranged such that the horizontal plane 22*a* and the fixed portion 23 of the contact portion 22 adhere closely on the bottom surface of the upper insulating case 2B.

Figure 3:
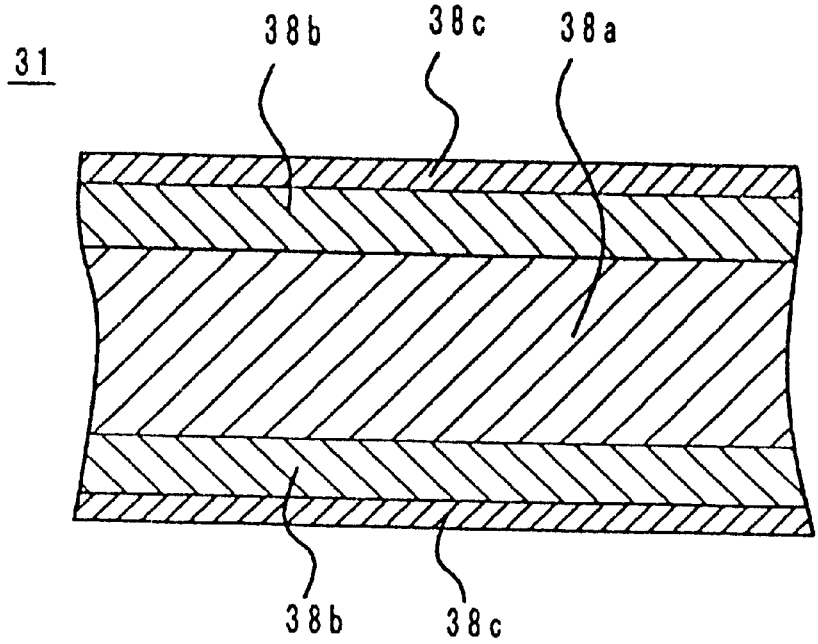
FIG. 3 is a sectional view of a movable terminal of the coaxial connector shown in FIG. 1.

The movable terminal 31 is preferably formed by punching an SUS 301 stainless steel plate having a spring property so as to have a predetermined shape and bending it. Then, as shown in FIG. 3, on the surfaces of the stainless steel (SUS 301) 38*a*, nickel plating films 38*b* are formed, and moreover, on the nickel plating films 38*b*, gold plating films 38*c* are formed so that the movable terminal 31 has an overall thickness in the range from about 45 vm to about 62 $\mu$m. Young's moduli of the stainless steel (SUS 301) and nickel are approximately 200 Gpa, respectively, and the Young's modulus of gold is about 80 Gpa. Therefore, the Young's modulus of gold is sufficiently smaller compared to those of the stainless steel (SUS 301) and nickel, and furthermore, since the thickness of the gold plating ranges approximately from 0.05 $\mu$m to 0.15 $\mu$m, the influence of the gold plating on the spring characteristics of the movable terminal 31 and an increase in the thickness of the movable terminal 31 are negligible.

The movable terminal 31 preferably includes a movable contact portion 32 having a movable spring function and arranged so as to contact the fixed terminal 21, a fixed portion 33 sandwiched by the insulating cases 2A and 2B therebetween, and a lead 34 that is bent to have a substantially L-shaped configuration. The movable contact portion 32 having a structure of a beam supported at both ends preferably includes a substantially U-shaped frame 37, a movable spring portion 39 extending over two arms 37*a* and 37*b* of the frame 37, and a spring contact portion 38 disposed at the approximate center of the movable spring portion 39. In the movable spring portion 39, the length ranges approximately from about 1 mm to about 3 mm (the representative value is about 2 mm). Both ends of the movable spring portion 39 are supported and fixed to the arms 37*a* and 37*b*. The central portion of the movable spring portion defines a substantially circular arc so as to swell upwardly. Due to the urging force caused by the spring property of the substantially circular-arc-spring mechanism, the spring contact portion 38 abuts the bottom surface of the contact portion 22 of the fixed terminal 21, so that the fixed terminal 21 comes into contact with and connects to the movable terminal 31.

Both sides of the fixed portion 33 are provided with substantially semi-circular recesses 36 formed thereon, which are respectively fitted by the legs 18 of the upper insulating case 2B so that the movable terminal 31 is assembled to the upper insulating case 2B with a high degree of positional accuracy. At this time, the movable terminal 31 is assembled in a state that the fixed portion 33 adheres closely on the bottom surface of the upper insulating case 2B.

An external terminal 41, which comes into contact with an external conductor of another coaxial connector, is preferably formed by punching, bending, and drawing a metallic plate of brass or phosphor bronze for springs, or other suitable material. A flat portion 42 of a central plate portion thereof is covered so as to adhere on the top surface of the upper insulating case 2B. The four corners of the flat portion 42 are respectively provided with legs 43 which are bent along side surfaces and the bottom surface of an assembly including the terminals 21 and 31 and insulating cases 2A and 2B, thereby reliably and securely constructing a solid assembly.

In the center of the flat portion 42, a through cylinder 45 is formed coaxially with the substantially cylindrical introducing section 12 of the insulating case 2B. The through cylinder 45 is fitted by the external conductor of another coaxial connector. The external terminal 41 usually performs grounding and external surfaces thereof can be plated as desired.

A perspective view of a coaxial connector 1 assembled in such a manner viewed from the top surface thereof is shown in FIG. 2. The coaxial connector 1 is preferably surface-mounted on a printed circuit board 61 by reflowing with solder 62.

Next, the operation of the coaxial connector 1 will be described with reference to FIGS. 4 and 5.

Figure 4:
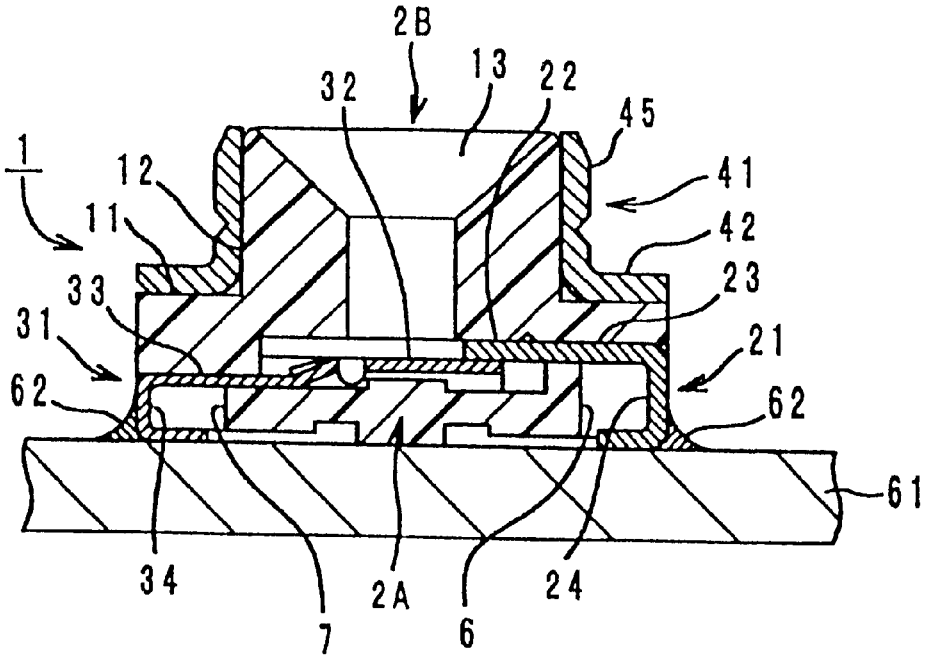
FIG. 4 is a sectional view of the coaxial connector shown in FIG. 2.

As shown in FIG. 4, when another coaxial connector is not attached thereto, the movable contact portion 32 is in a state that the central portion thereof swells upwardly. Therefore, the movable terminal 31 contacts the fixed terminal 21 due to an urging force generated by a spring property of the movable contact portion 32, so that both terminals 21 and 31 are electrically connected together.

Figure 5:
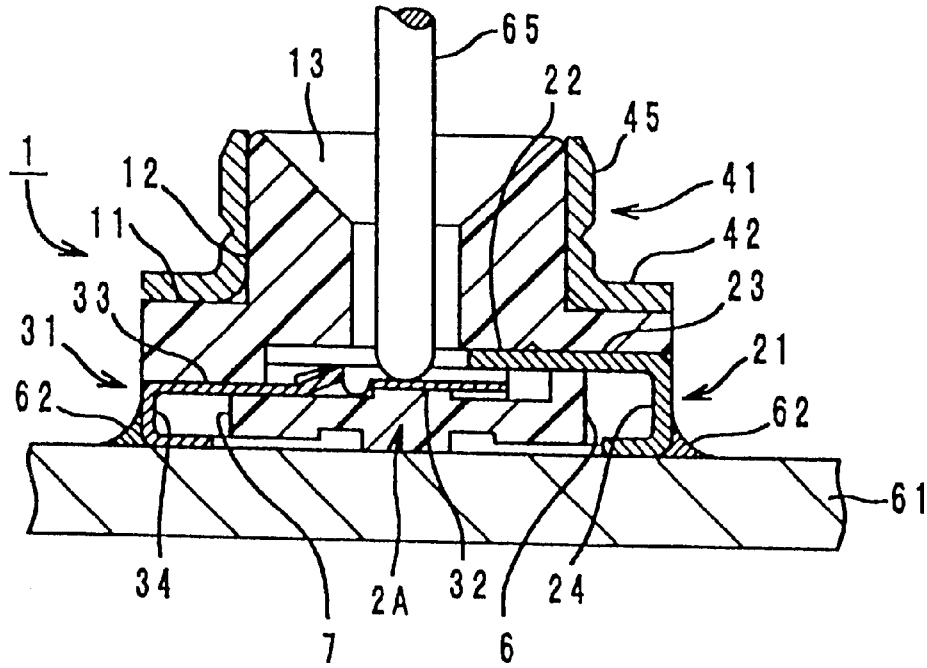
FIG. 5 is a sectional view of the coaxial connector shown in FIG. 2 when another coaxial connector is fitted thereto.

In contrast, as shown in FIG. 5, when another coaxial connector is attached thereto, the central portion of the movable contact portion 32 is pushed downwardly so as to be reversed by a central contact 65 of the other coaxial connector inserted from the introduction hole 13 in the upper side, so that the central portion defines a substantially circular arc so as to swell downwardly. Thereby, the spring contact portion 38 of the movable terminal 31 is separated from the contact portion 22 of the fixed terminal 21 so that the electrical connection between the fixed terminal 21 and the movable terminal 31 is cut off while the central contact 65 and the movable terminal 31 are electrically connected together. Simultaneously, an external conductor of another coaxial connector (not shown) is fitted into the external terminal 41, so that the external conductor also is electrically connected to the external terminal 41.

When another coaxial connector is detached from the coaxial connector 1, the central portion of the movable contact portion 32 is returned to the state of swelling upwardly due to the spring property. Thereby, the fixed terminal 21 and the movable terminal 31 are electrically connected together again while the electrical connection between the central contact 65 and the movable terminal 31 is cut off.

Figure 6:
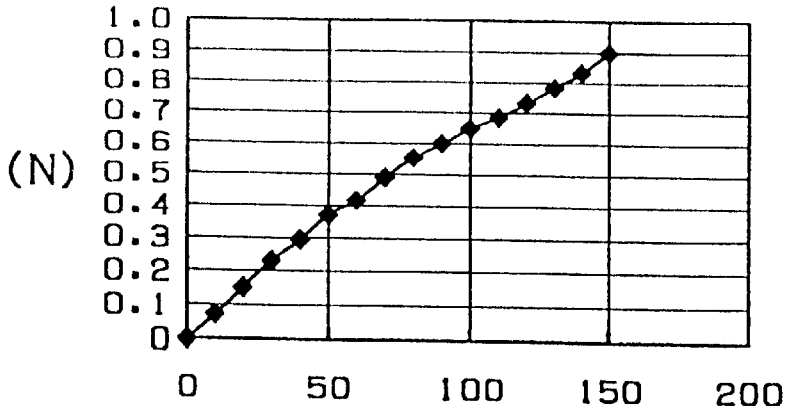
FIG. 6 is a graph showing the relationship between a pushing load of the movable terminal of the coaxial connector shown in FIG. 1 and a displacement thereof.

The operation will be described more specifically. FIG. 6 is a graph showing the relationship between a pushing load and a displacement of the movable terminal 31 when the thickness thereof is approximately 50 $\mu$m. From FIG. 6, it is understood that the spring constant of the movable terminal 31 is about 0.0058 N/$\mu$m. Furthermore, the deterioration in the spring constant could not be recognized even on 5000 cycles of displacements of the movable terminal 31. As shown in FIG. 4, when another coaxial connector is not attached thereto, the spring contact portion 38 abuts the fixed terminal 21 in a state that the spring contact portion 38 is lowered by about 50 $\mu$m from a no-load position. At this time, as is understood from FIG. 6, the pushing load was about 0.37 N, thus exceeding the stable pushing load of about 0.2 N that is required to maintain a stable contact connection.

Incidentally, it is preferable to use SUS 304 stainless steel also as a material for the movable terminal 31. When attaching and detaching of the coaxial connector using the movable terminal 31 made of SUS 304 stainless steel to and from another coaxial connector were repeated at ambient temperatures of approximately 80° C. to 100° C., creeping was generated in the movable terminal 31 so that the pushing load of the movable terminal 31 was reduced. The pushing load was lower than the stable pushing load of about 0.2 N and was unsuitable for using in the movable terminal. On the other hand, in the coaxial connector 1 using the movable terminal 31 made of SUS 301, the pushing load was not lower than the stable pushing load of about 0.2 N.

Therefore, the movable terminal 31 is preferably provided with the movable spring portion 39 made from SUS 301 stainless steel and having a beam supported at both ends enabling a spring force larger than that of a conventional device to be obtained, so that the stable pushing load of about 0.2 N can be maintained even when the size of the movable terminal 31 is reduced, thereby obtaining secure and stable contact and connection. Moreover, even when the thickness of the SUS 301 stainless steel varies, by plating the stainless steel with nickel having a Young's modulus that is similar to that of the SUS 301 stainless steel, changes in the spring force due to differences in the thickness of the SUS 301 stainless steel of the movable spring portion 39 are compensated for.

When the thickness of the movable terminal 31 is below about 45 $\mu$m, the spring force is too small so that the pushing load is lower than the stable pushing load of about 0.2 N. When the thickness of the movable terminal 31 is greater than approximately 62 $\mu$m, the spring force is too large so that problems may arise, such that when another coaxial connector is attached, the central contact 65 is deformed, contacts of the fixed terminal 21 and the movable terminal 31 cannot be separated therefrom, and so forth.

Another preferred embodiment of the present invention will be described as a communication apparatus using a portable telephone, as an example.

Figure 7:
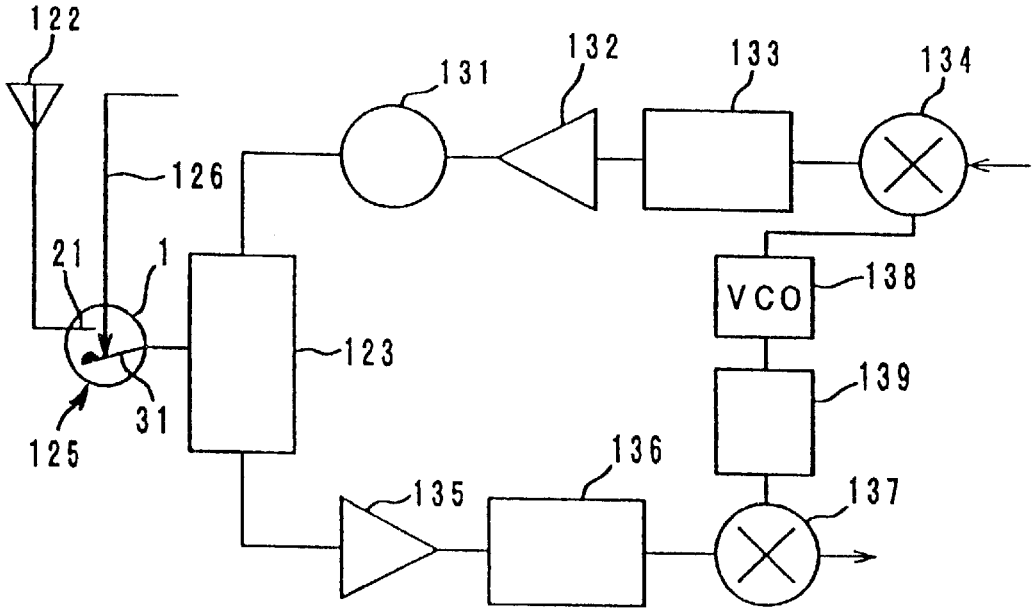
FIG. 7 is a block diagram of a communication apparatus according to another preferred embodiment of the present invention.

FIG. 7 is an electrical circuit block diagram of an RF circuit of a portable telephone 120. In FIG. 7, the portable telephone 120 preferably includes an antenna element 122, a duplexer 123, a selector switch 125, an isolator in the transmitting side 131, an amplifier in the transmitting side 132, an interstage band-pass filter in the transmitting side 133, a mixer in the transmitting side 134, an amplifier in the receiving side 135, an interstage band-pass filter in the receiving side 136, a mixer in the receiving side 137, a voltage-control oscillator (VCO) 138, and a local band-pass filter 139.

As the selector switch 125, the coaxial connector 1 according to the first preferred embodiment described above can be used. Thereby, when a portable telephone manufacturer checks electrical characteristics of the RF circuit in the manufacturing process of the portable telephone 120, for example, as long as the coaxial connector 1 is attached to a measuring probe 126 (another coaxial connector) connected to a measuring instrument, the signal path from the RF circuit to the antenna element 122 can be switched to the signal path from the RF circuit to the measuring instrument. When the measuring probe 126 is detached from the coaxial connector 1, the signal path from the RF circuit to the antenna element 122 is again returned. By mounting the coaxial connector 1 thereon, the portable telephone 120 with high reliability can be achieved.

The present invention is not limited to the above-described preferred embodiments, and various modifications can be made within the spirit and scope of the invention.

In various preferred embodiments, the coaxial connector is described, in which after each terminal and each insulating case are separately manufactured, both of these components are assembled together. However, the terminal may be formed integrally with the insulating case by insert molding. The external shape of the insulating case and the shape of the recess may be selected according to specifications from among arbitrary shapes such as substantially rectangular, substantially circular shapes or other suitable shapes.

Also, each terminal is not limited to a surface-mounting type. However, the terminal may be an insert-mounting type. After the movable contact portion, the fixed portion, and the lead of the movable terminal are separately manufactured, they may be connected together by welding or other suitable method.

It will be apparent from the foregoing that, while the present invention has been described in detail and illustrated, there are only particular illustrations and examples and the invention is not limited to these, the spirit and scope of the present invention is limited only by the appended claims.

What is claimed is:

1. A movable terminal comprising:

a frame;

a movable spring portion having two ends that are supported by the frame and a central portion thereof that is movable and is elastic;

a contact portion that is integral with the movable spring portion and that is arranged to come into contact with and connect to a fixed terminal;

a fixed portion that is integral with the frame and is arranged to be sandwiched by an upper insulating case portion and a lower insulating case portion of a coaxial connector; and a lead extending from the fixed portion; wherein the fixed portion includes at least one recess provided therein for being fitted to a leg disposed on the upper insulating case portion of the coaxial connector so as to accurately locate the movable terminal with respect to the upper insulating case portion.

2. A movable terminal according to claim 1, wherein the movable terminal is made of SUS 304 stainless steel.

3. A movable terminal according to claim 1, wherein the movable terminal includes a lead having an L-shaped configuration.

4. A movable terminal according to claim 1, wherein the central portion of the movable spring portion defines a substantially circular arc that swells upwardly.

5. A movable terminal according to claim 1, wherein the movable spring portion is arranged such that the spring contact portion abuts the bottom surface of the contact portion of the fixed terminal, so that the fixed terminal comes into contact with and connects to the movable terminal.

6. A movable terminal according to claim 1, wherein at least the movable spring portion is made of SUS 301 stainless steel, a nickel plating film is disposed on the SUS 301 stainless steel, and a gold plating is disposed on the nickel plating film.

7. A movable terminal according to claim 6, wherein an entire thickness of the movable spring portion including the SUS 301 stainless steel, the nickel plating film and the gold plating film disposed thereon ranges from about 45 $\mu$m to about 62 $\mu$m.

8. A coaxial connector comprising:

an insulating case having a recess formed therein and arranged to receive a central contact of another coaxial connector that is to be inserted therein, said insulating case includes upper and lower case portions;

a movable terminal including:

a frame;

a movable spring portion having two ends that are supported by the frame and a central portion thereof that is movable and is elastic;

a contact portion that is integral with the movable spring portion and that is arranged to come into contact with and connect to a fixed terminal; and at least one recess provided in said frame;

wherein the movable terminal is arranged within the recess of the insulating case so as to protrude in a direction that is substantially perpendicular to the inserting direction of the central contact of the other coaxial connector, and said at least one recess is fitted to said upper case portion of said insulating case so as to accurately position the movable terminal in the insulating case;

a fixed terminal arranged within the recess of the insulating case so as to be brought into contact with and connected to the contact portion of the movable terminal; and an external terminal attached to the outside of the insulating case and electrically connected to an external conductor of the other coaxial connector;

wherein the contact portion of the movable terminal is arranged to be movable from a position at which the movable terminal is separated from the fixed terminal to a position at which the movable terminal is in contact with the fixed terminal in accordance with attachment and detachment of the other coaxial connector.

9. A coaxial connector according to claim 8, wherein insulating case includes a lower insulating case and an upper insulating case joined to each other.

10. A coaxial connector according to claim 9, wherein the lower insulating case has a substantially rectangular shape and guide projections are provided on each of four corners on the top surface of the lower insulating case for positioning the upper insulating case.

11. A coaxial connector according to claim 9, wherein the upper insulating case includes a substantially rectangular cover and a substantially cylindrical introducing section disposed in the central portion on the top surface of the cover, the substantially cylindrical introducing section is upwardly opened to have a conical shape and has a substantially circular-cross-sectional introduction hole for receiving a central contact of a coaxial connector of another component.

12. A coaxial connector according to claim 8, wherein the movable terminal is made of SUS 304 stainless steel.

13. A coaxial connector according to claim 8, wherein the movable terminal includes a lead having an L-shaped configuration.

14. A coaxial connector according to claim 8, wherein the central portion of the movable spring portion defines a substantially circular arc that swells upwardly.

15. A coaxial connector according to claim 8, wherein the movable spring portion is arranged such that the spring contact portion abuts the bottom surface of the contact portion of the fixed terminal, so that the fixed terminal comes into contact with and connects to the movable terminal.

16. A communication apparatus comprising a coaxial connector according to claim 8.

17. A coaxial connector according to claim 8, wherein at least the movable spring portion is made of SUS 301 stainless steel, a nickel plating film is disposed on the SUS 301 stainless steel, and a gold plating film is disposed on the nickel plating film.

18. A coaxial connector according to claim 17, wherein an entire thickness of the movable spring portion including the SUS 301 stainless steel, the nickel plating film and the gold plating film disposed thereon ranges from about 45 $\mu$m to about 62 $\mu$m.

* * * * *